US005706974A

United States Patent [19]

Murdick et al.

[11] Patent Number: 5,706,974

[45] Date of Patent: Jan. 13, 1998

[54] CAN FOR POWDER PRODUCTS HAVING SCOOP RETAINING MEANS

[75] Inventors: Brian Kendall Murdick, Columbus; Thomas Walter Osip, Dublin, both of Ohio

[73] Assignee: Abbott Laboratories, Abbott Park, Ill.

[21] Appl. No.: 575,924

[22] Filed: Dec. 20, 1995

[51] Int. Cl.[6] ..... A45C 11/20

[52] U.S. Cl. ..... 220/735; 220/212; 215/390; 215/228; 206/541; 206/230; 426/115; 30/324; 73/426

[58] Field of Search ..... 220/212, 212.5, 220/735, 729, 521, 523, 522; 215/228, 386, 390, 391, DIG. 5; 222/192; 73/426; 30/128, 141, 147, 149, 150, 324; 206/229, 230, 542, 541, 217, 219; 426/115

[56] References Cited

U.S. PATENT DOCUMENTS

| | | | |
|---|---|---|---|
| D. 141,881 | 7/1945 | Mathewson | 73/426 |
| D. 239,907 | 5/1976 | Olsson | 73/426 X |
| 1,607,865 | 11/1926 | Butler | 215/DIG. 5 X |
| 1,703,185 | 2/1929 | White | 215/DIG. 5 X |
| 1,768,771 | 7/1930 | Tourrette | 73/426 |
| 1,853,852 | 4/1932 | Estes | 220/735 |
| 2,738,900 | 3/1956 | Wenger | 220/735 X |
| 2,789,608 | 4/1957 | Tupper | 220/306 |
| 3,001,404 | 9/1961 | McDonnell, Jr. et al. | 215/DIG. 5 X |
| 3,312,366 | 4/1967 | Poris | 220/521 |
| 3,722,779 | 3/1973 | Chang | 220/735 X |
| 5,325,962 | 7/1994 | Ouellette | 220/521 X |
| 5,347,865 | 9/1994 | Mulry et al. | 73/426 X |

FOREIGN PATENT DOCUMENTS

| | | | |
|---|---|---|---|
| 722740 | 3/1932 | France | 215/DIG. 5 |
| 4036945 | 5/1992 | Germany | 220/212 |
| 386032 | 1/1933 | United Kingdom | 215/DIG. 5 |

*Primary Examiner*—Allan N. Shoap
*Assistant Examiner*—Nathan Newhouse
*Attorney, Agent, or Firm*—Brian R. Woodworth

[57] ABSTRACT

A lid for a container designed to contain powder or granular materials includes a lip on an interior or bottom surface of the lid for selectively attaching a scoop. The lip is resiliently deformable when an edge of the scoop is pressed against it. This deforming creates an interference fit, thereby securing the scoop to the undersurface of the lid. When the scoop is to be used, it can be easily removed from the lid without the need for rooting and searching within the container for the lid.

4 Claims, 4 Drawing Sheets

CAN FOR POWDER PRODUCTS HAVING SCOOP RETAINING MEANS

BACKGROUND OF THE INVENTION

1. Field of Invention

This invention pertains to the art of containers and closure means for containers, and more specifically to a lid for a container having a means for retaining a scoop to an interior surface of the lid.

2. Description of the Related Art

Containers for powdered and granular materials are known. Many of these containers are cylindrical in configuration and incorporate lids to selectively seal an open top of a container. When such containers are used for materials having a powder or granular consistency, such as baby formula, flour, coffee, and the like, a scoop is sometimes included inside the container.

When the user wishes to withdrawal a portion of the enclosed powdered or granular material, they must root around in the material with their fingers until the scoop is located. This process often is messy, soiling the user's hands and perhaps clothing or countertop. In addition, it is unsanitary, in that the user's hand contacts, and perhaps contaminates, the material to be consumed.

The present invention contemplates a new and improved container and lid which is simple in design, effective in use, and overcomes the foregoing difficulties in others while providing better and more advantageous overall results.

SUMMARY OF THE INVENTION

In accordance with the present invention, a new and improved container and lid is provided which is adapted to selectively secure a scoop to an interior surface of the lid.

More particularly, in accordance with the invention, the lid includes attaching means for selectively attaching a scoop to the lid.

In accordance with another aspect of the invention, the lid has an interior and an exterior surface. The attaching means comprises a lip which extends outwardly from the lid.

According to another aspect of the invention, the lip fits and cooperates with an edge of the scoop to secure the scoop to the lid via an interference fit.

According to another aspect of the invention, an article for repeatedly sealing and unsealing an associated container for powder or granular materials includes a lid, a scoop, and attaching means for attaching the scoop to the lid. The lid includes a planar portion, an interior surface, an exterior surface, and an edge defining the planar portion.

According to a still further aspect of the invention, a method of attaching a scoop to a lid in an associated container includes the steps of aligning an edge of the scoop with an attaching means on the lid and pressing the scoop against the attaching means, thereby deforming the attaching means and generating an interference fit between the scoop and the attaching means.

One advantage of the present invention is the provision of a new lid which can be used to selectively seal the container.

Another advantage of the invention is the provision of a lid with an attaching means for selectively securing a scoop to a surface of the lid.

Another advantage of the present invention is the fact that the invention selectively secures the scoop to the lid without moving parts to wear or break. Therefore, the invention can be inexpensively manufactured and be durable and serve its purpose well.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
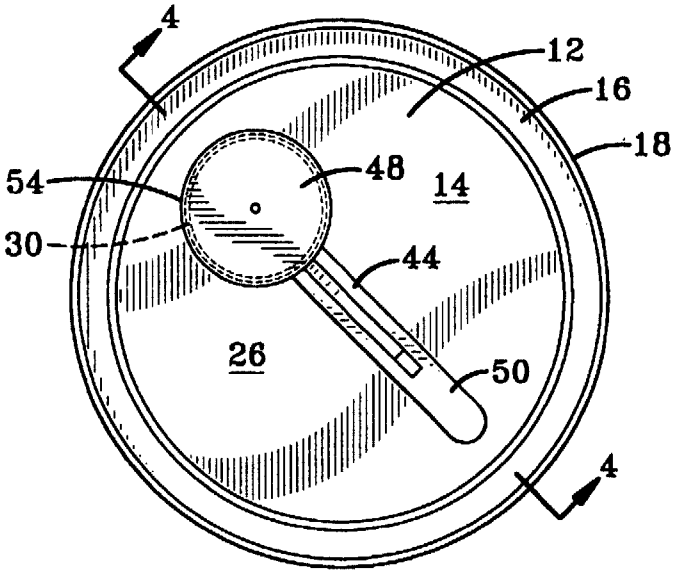
FIG. 1 is a bottom view of a lid, scoop, and attaching means according to the invention.
Figure 2:
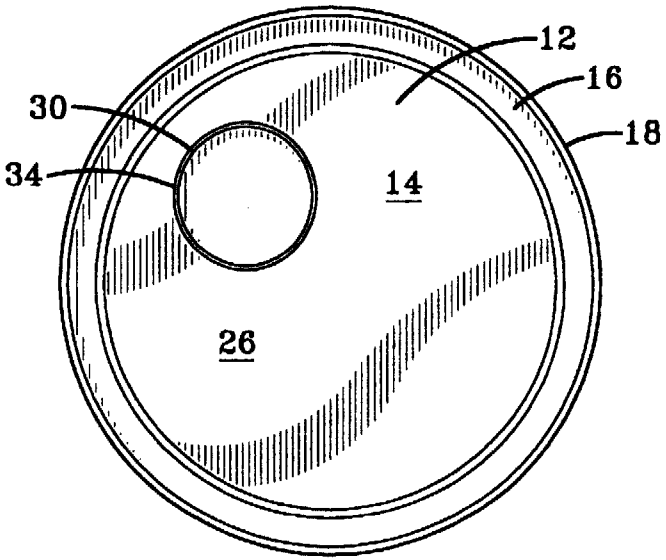
FIG. 2 is a bottom view of a lid and attaching means, without the scoop, according to the invention.

Referring now to the drawings which are provided for the purpose of illustrating a preferred embodiment of the invention only and not for the purpose of limiting the same, FIG. 1 shows a bottom view of a lid 12. The lid 12 includes a planar portion 14 and a rim 16. The radially outer portion of the lid 12 is defined by an edge 18.

Figure 3:
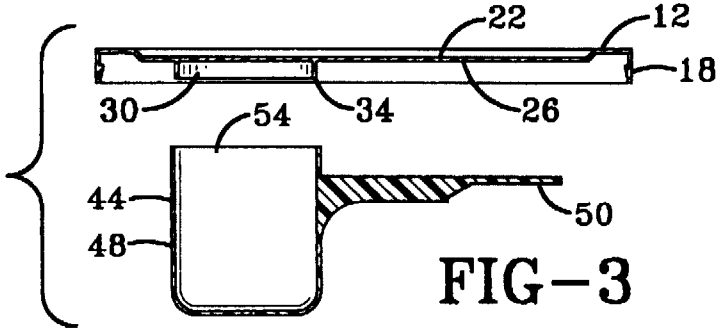
FIG. 3 is an exploded side view, in partial cross-section, of a lid, attaching means, and scoop according to the invention.
Figure 4:
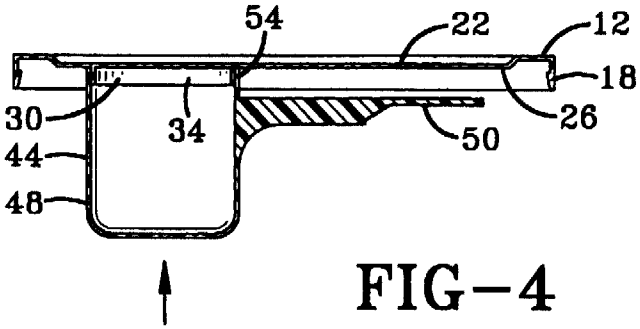
FIG. 4 is a side view, in partial cross-section, of a lid, attaching means, and scoop according to the invention.

With reference to FIGS. 3 and 4, one can see that the top or exterior surface 22 is essentially flat.

With reference to FIG. 3, one can see that the bottom or interior surface 26 is generally flat or planar, but for the presence of attaching means 30. In the preferred embodiment, the attaching means 30 takes the form of a lip 34 which extends outwardly from the lid 12. In its preferred embodiment, the lip 34 extends axially outwardly from the lid 12 and inwardly into the interior 36 of an associated container 40.

The lip 34 extends outwardly from the lid 12 a distance between 0.10 inches and 0.5 inches, but preferably extends about 0.20 inches. The lip 34 is preferably made of the same material as the lid 12, although this is not necessary. Presently, the preferred material for the lid 12 and the lip 34 is plastic.

With reference to FIGS. 1–4 and 8, the inventive lid 12 and attaching means 30 are designed to be used in conjunction with a scoop 44. The scoop 44 can take nearly any configuration, with the scoop 44 illustrated being of a common design. The scoop 44, as illustrated, include a cup portion 48 and handle 50. The cup portion 48 is defined by an edge 54. It is the edge 54 of the cup portion 48 of the scoop 44 which cooperates and fits against the lip 34 of the lid 12. In the preferred embodiment, the edge 54 of the scoop 44 circumscribes or fits around the lip 34, so that the lip 34 fits inside the scoop 44 when the scoop 44 is attached to the interior surface of the lid 12. The lip 34 deforms between 0.01 inches and 0.20 inches by such interference fit. In one embodiment, the interference fit loosens, and the scoop 44 "clicks", when the scoop 44 is fully secured to the attaching means.

Figure 6:
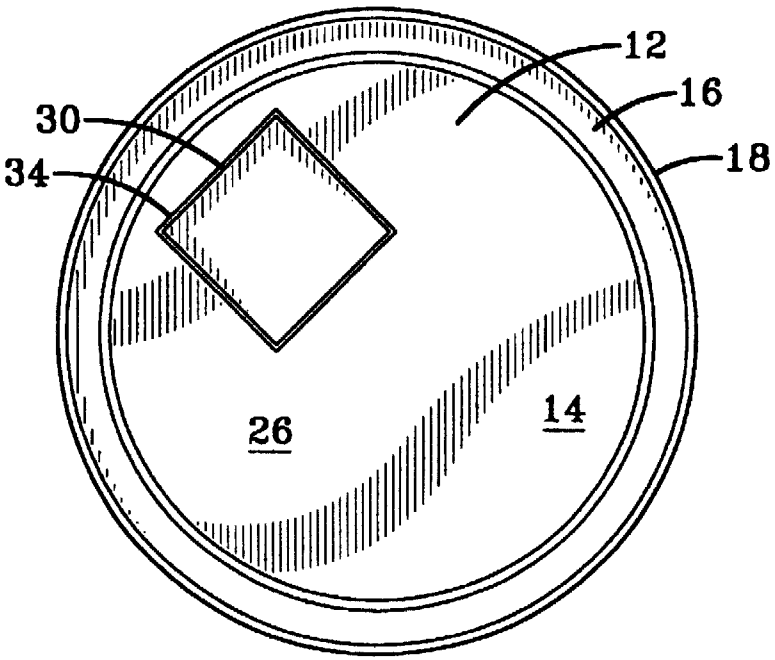
FIG. 6 is a bottom view of another embodiment of the invention, with the scoop removed.
Figure 5:
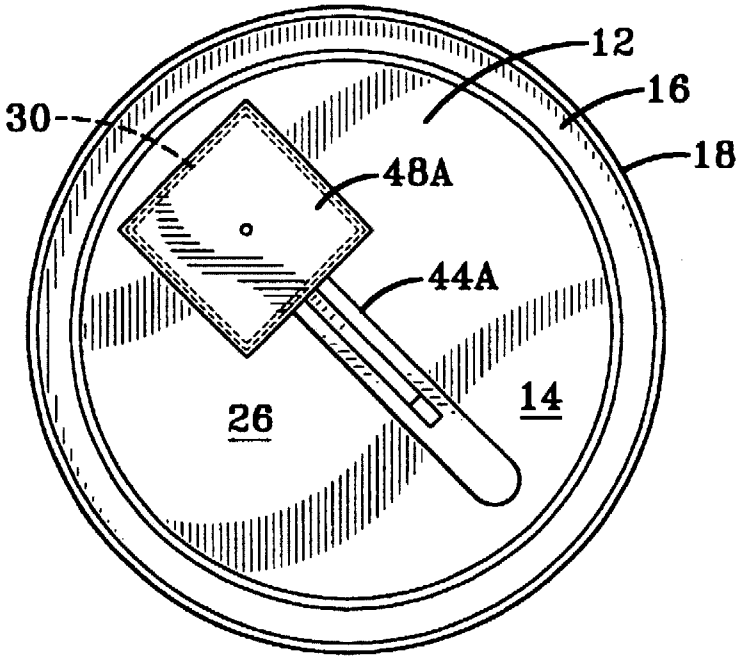
FIG. 5 is a bottom view of another embodiment of the invention, showing the scoop attached to the lid.
Figure 7:
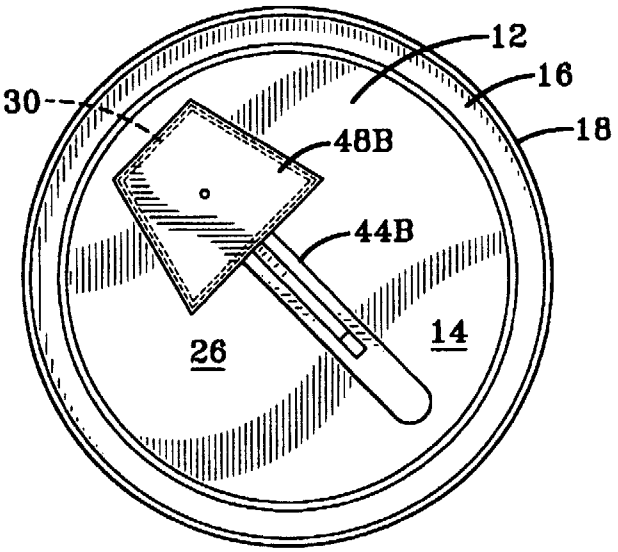
FIG. 7 is a bottom view of another embodiment of the invention, showing the scoop attached to the lid.

Although the preferred embodiment scoop 44 has a cylindrical cup portion 48, therefore having a round edge 54, other shapes of scoops 44 can be successfully used. For example, with reference to FIGS. 5 and 6, a square-shaped cup portion 48A of a scoop 44A is illustrated. Further, in FIG. 7, a scoop 44B with a trapezoidally-shaped cup portion 48B is illustrated. In each case, the lip 34 should be configured so that it corresponds to the shape of the edge 54 of the scoop 44.

Figure 9:
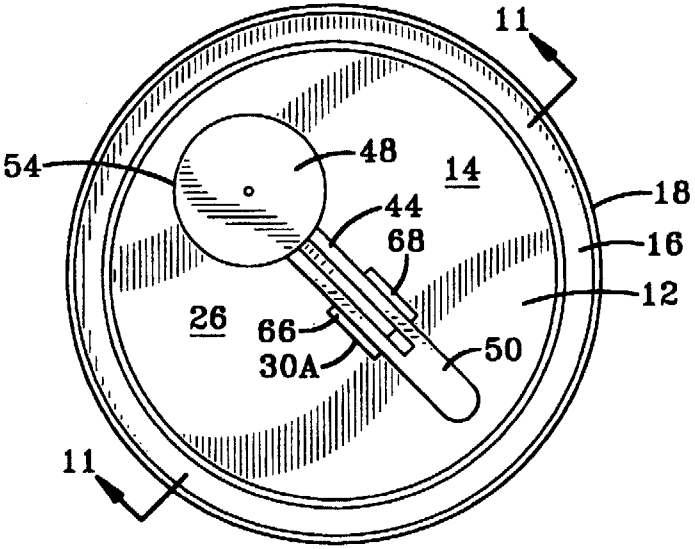
FIG. 9 is a bottom view of another embodiment of the attaching means.
Figure 11:
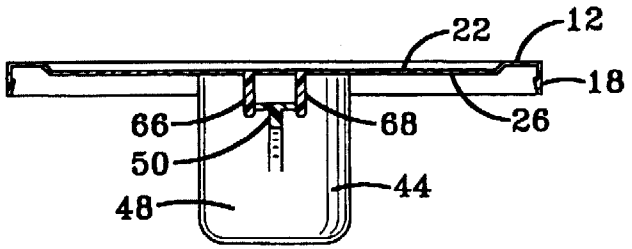
FIG. 11 is a side view of the embodiment FIG. 10 taken alone line 11—11 of FIG. 10.
Figure 10:
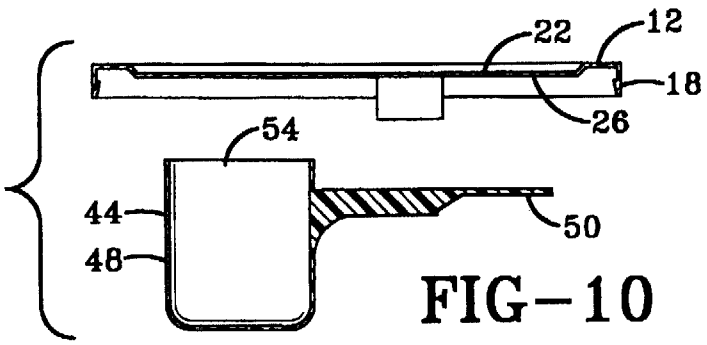
FIG. 10 is a bottom view of another embodiment of the attaching means.

Another form of attaching means is illustrated in FIG. 9–11. In this embodiment, the attaching means 30A has two inwardly extending prongs 66, 68 which grip the handle 50 of the scoop 44, rather than the edge 54 of the cup portion 48. A still further embodiment incorporates a U-shaped cross-section rather than the prongs 66, 68.

Figure 8:
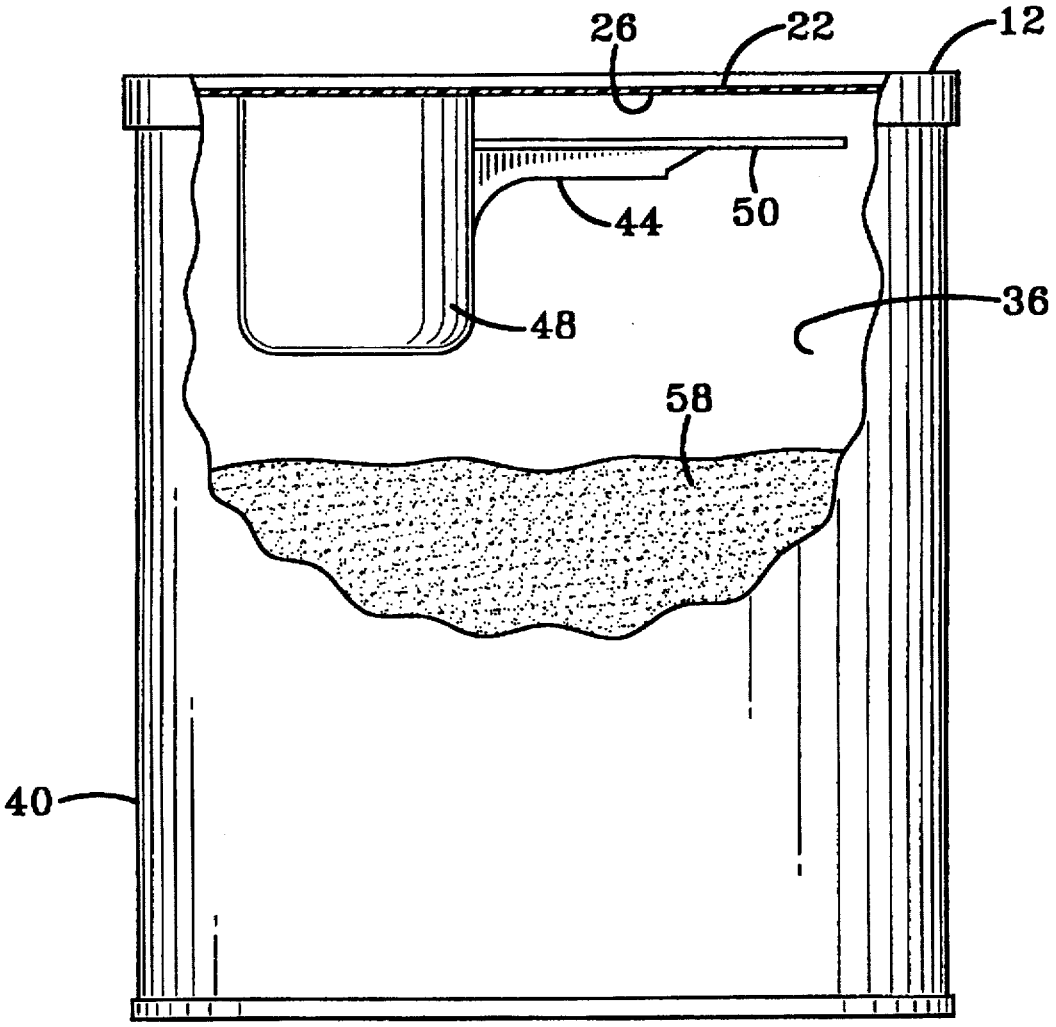
FIG. 8 is a side view in partial cross-section of the invention used in conjunction with an associated container.

With reference to FIG. 8, the method of utilizing the inventive article will be described. The method of attaching a scoop to a lid in an associated container includes the steps of aligning an edge of the scoop with an attaching means on the lid and pressing the scoop against the attaching means, thereby deforming the attaching means and generating an interference fit between the scoop and the attaching means.

Containers 40 commonly are designed to hold materials 58 which are granular or powdered. Some typical examples include flour, coffee, sugar, and baby formula. When the consumer wishes to withdraw a portion of the materials 58 from the container 40, they must first root around in the interior 36 with their fingers of the container 40 to find the scoop 44. Once located, the scoop 44 is initially withdrawn so that it can be used. The scoop 44, having been buried in the material 58, is usually covered with the material 58. This often soils the user's hands. It also often results in spillage of the material 58 onto a countertop or table on which the container 40 is sitting. Besides the waste of the material 58 and the mess involved, the material 58 can also be contaminated by contact with the user's hands.

Once the scoop 44 is located and gripped by the consumer, it can be used to withdraw the desired amount of material 58. Typically, the scoop 44 is then placed back into the container 40 and the lid 12 is replaced. The next time the material 58 is to be withdrawn from the container 40, the process is repeated.

According to the new inventive method above-described, the process must only be carried out the first time the container 40 is open and the scoop 44 is retrieved. Once retrieved, the scoop 44 can be attached to the interior surface 26 of the lid 12 for all subsequent times the scoop 44 is to be used. Therefore, the materials 58 will not spilled, wasted, or contaminated by contact with the user's hand.

While the scoop 44 is preferably attached to the bottom or interior surface 26 of the lid 12, some of the advantages of the invention could also be obtained by forming attaching means 30 to the top or exterior surface 22 of the lid 12. While this embodiment is not preferred, it is foreseeable and within the scope of the invention.

The invention has been described with reference to a preferred embodiment. Modifications and alterations will occur to others upon a reading and understanding of this specification. It intended to include all such modifications and alterations in so far as they come within the scope of the appended claims or the equivalents thereof.

Having thus described the invention, it is now claimed:

What is claimed is:

1. A lid for a container, said lid comprising:

a body portion comprising a planar portion and a rim portion circumferentially surrounding said planar portion, said planar portion having an interior surface and an exterior surface, said rim portion constructed to mate with a container, said interior surface facing the container;

a lip extending from said interior surface of said planar portion, said lip constructed of a resilient material, said lip having an exterior surface; and a scoop having a cup portion, said cup portion having an open end constructed to frictionally engage said exterior surface of said lip as said scoop is moved towards said interior surface of said planar portion.

2. A lid for a container in accordance with claim 1, wherein said lip extends from said planar portion between 0.10 inches and 0.50 inches.

3. A lid for a container in accordance with claim 1, wherein said lip is constructed to deform between 0.01 inches and 0.20 inches.

4. An article for storing a powdered or granular material, said article comprising:

a container constructed to contain a powdered or granular material;

a lid constructed to seal said container, said lid comprising:

a body portion comprising a planar portion and a rim portion circumferentially surrounding said planar portion, said planar portion having an interior surface and an exterior surface, said rim portion constructed to mate with said container, said interior surface facing the container;

a lip extending from said interior surface of said planar portion, said lip constructed of a resilient material, said lip having an exterior surface; and a scoop having a cup portion, said cup portion having an open end constructed to frictionally engage said exterior surface of said lip as said scoop is moved towards said interior surface of said planar portion.

* * * * *